United States Patent [19]

Fortino

[11] 3,989,334

[45] Nov. 2, 1976

[54] EXTENSION CORD TERMINAL WITH SAFETY CLOSURES

[75] Inventor: Samuel S. Fortino, Huntington, N.Y.

[73] Assignee: Gem Electric Manufacturing Co., Inc., Hauppauge, N.Y.

[22] Filed: May 14, 1975

[21] Appl. No.: 577,222

[52] U.S. Cl. ..... 339/41

[51] Int. Cl.[2] ..... H01R 13/44

[58] Field of Search ..... 339/36–38, 339/28, 40, 41

[56] References Cited

UNITED STATES PATENTS

| | | | |
|---|---|---|---|
| 2,515,003 | 7/1950 | Hamilton | 339/41 |
| 3,663,924 | 5/1972 | Gerlat | 339/28 |
| 3,879,098 | 4/1975 | Lawrence et al. | 339/41 |

*Primary Examiner*—Roy Lake
*Assistant Examiner*—Craig R. Feinberg
*Attorney, Agent, or Firm*—Kirschstein, Kirschstein, Ottinger & Frank

[57] ABSTRACT

A cord conductor of two insulated conductor strands has a female terminal molded at one end and a conventional plug at the other. The female terminal has a pair of female contacts positioned therein which are in permanent electrical connection with their associated conductor strands. The female terminal is provided with a pair of terminal openings therein, the openings being adapted to frictionally receive the prong from a duplex plug that is in electrical connection with an electrical appliance. When the prongs are frictionally positioned in the terminal openings they are in slidable engagement with the female contacts to complete a portion of an electrical circuit.

The pair of terminal openings has a safety closure associated therewith. The safety closure is mounted between the terminal openings and is movable between a first and a second position. In its first position the safety closure is recessed in the female terminal to expose the terminal openings and to permit the prongs of a plug to be inserted therein. In the second position tabs on the safety closure frictionally enter the terminal openings to dielectrically seal the terminal openings.

5 Claims, 5 Drawing Figures

EXTENSION CORD TERMINAL WITH SAFETY CLOSURES

BACKGROUND OF THE INVENTION

1. Field of the Invention

The invention relates to an electrical tap for an extension cord and more particularly to an electrical tap with one or more safety closures to dielectrically seal the terminal openings which are not being used.

2. Prior Art

The use of electrical taps or terminals, and more particularly, electrical taps having multiple terminals therein, in conjunction with extension cords is old in the art. Such extension cords commonly are used around the home to deliver current to electrical appliances when the cord attached to the electrical appliance is not of sufficient length to reach a wall socket. One problem associated with the use of extension cords having multiple terminals is that when only one appliance is connected to the terminal the remaining terminal openings are left exposed. These exposed terminal openings present a hazard. Small children, especially those in their crawling years, have an insatiable curiosity and have been known to insert various objects into the exposed terminal openings. When the object is a conductor of electricity, the child can receive a severe electrical shock which may result in a serious, if not fatal injury.

To this end, safety caps have been developed to seal off the unused terminal openings in the electrical taps. One such device is disclosed in U.S. Pat. No. 3,389,367. This safety cap has a plurality of sections integrally connected by flexible webs. A central portion is adapted to be mounted on the extension cord and the outer portions have tabs which enter the openings in the electrical tap thereby sealing the openings when not in use. One of the drawbacks with this device is that it can be used only in conjunction with a multiple tap having one pair of openings on each face. That is, if one face of the multiple tap has more than one pair of openings therein, this device could not seal all the openings. If this device were modified to add an additional portion bearing tabs to seal the remaining openings the resulting device would be cumbersome and difficult to use. Further, because this safety cap can be separated readily from the electrical tap, the advantages of the safety cap can be easily defeated by simply removing the safety cap from the extension cord.

It is toward elimination of these and other problems that the present invention is directed.

SUMMARY OF THE INVENTION

1. Purposes of the Invention

It is an object of the present invention to provide an extension cord terminal having safety closures which will effectively seal the terminal openings which are not being used.

Another object of the present invention is to provide an extension cord terminal having safety closures wherein the closures are permanently fastened to the terminal so that they cannot be removed therefrom.

A further object of the present invention is to provide an extension cord terminal with safety closures which can be easily and economically manufactured.

Other objects of the invention in part will be obvious and in part will be apparent in the following description.

2. Brief Description of the Invention

Generally, the foregoing and other objects are achieved by a cord conductor having a female terminal mounted at one end. Female contacts within the female terminal are in permanent electrical connection with their associated insulated conductor strands comprising the cord conductor. At least one pair of openings is provided in the female terminal, each opening being adapted to frictionally receive a prong of a plug. The prongs of the plug, when positioned in the openings, slidably engage the female contacts.

Each pair of terminal openings has associated therewith a safety closure which is movable between a first and a second position. In its first position the safety closure is recessed between the terminal openings to thereby expose the openings and permit the prongs of a plug to be placed therein. In its second position the safety closure dielectrically seals the terminal openings.

The invention consists in the features of construction and arrangement of parts which will be detailed hereinafter and described in the appended claims.

BRIEF DESCRIPTION OF THE DRAWINGS

For a better understanding of the present invention, reference should be had to the accompanying drawings, wherein like numerals of reference indicate similar parts throughout the several views and wherein.

DESCRIPTION OF THE PREFERRED EMBODIMENT

Figure 1:
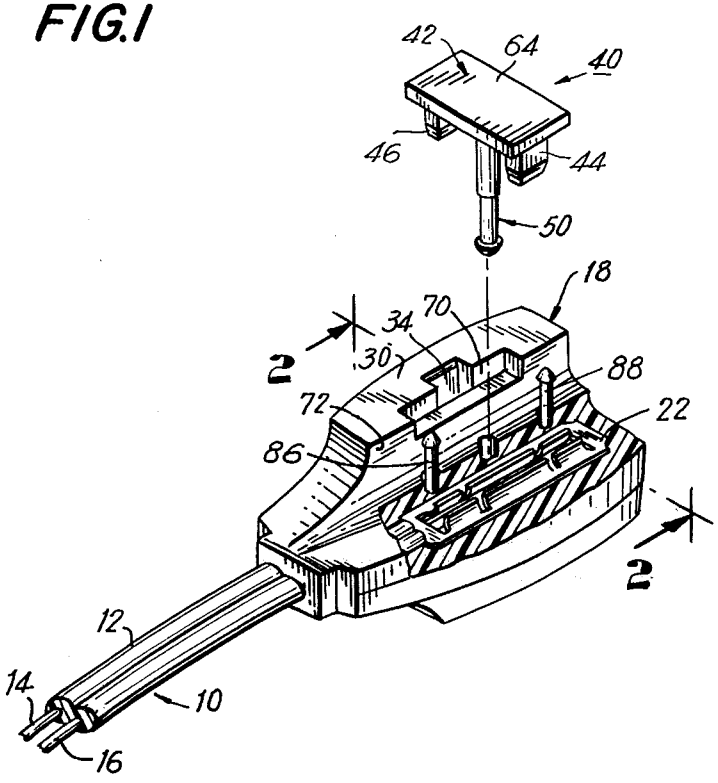
FIG. 1 is a partially broken away perspective exploded view of an extension cord terminal in accordance with the present invention.

With reference to the drawings, FIG. 1 illustrates an extension cord assembly 10 having a cord conductor 12 formed from two insulated conductor strands 14, 16, extending from a standard plug, not shown. The plug is adapted for insertion into a wall socket. Mounted at the end of the cord conductor 12 is an electrical tap or female terminal in the form of a body 18 having a pair of female contacts 20, 22 positioned therein, which are in permanent electrical connection with their associated insulated conductor strands 14, 16. The cord conductor 12 and the female terminal 18 are assembled in a conventional manner and preferably with the female terminal being of a synthetic thermoplastic dielectric and somewhat resilient material such as polyvinyl plastic and molded on the end of the cord conductor.

It is to be appreciated that while the female terminal 18 is shown as having a generally rectanguloid shape, it can have any shape which would allow the female terminal to be held in an individual's hand while a plug is inserted or removed from the terminal openings and while the position of the safety closures is changed.

Figure 5:
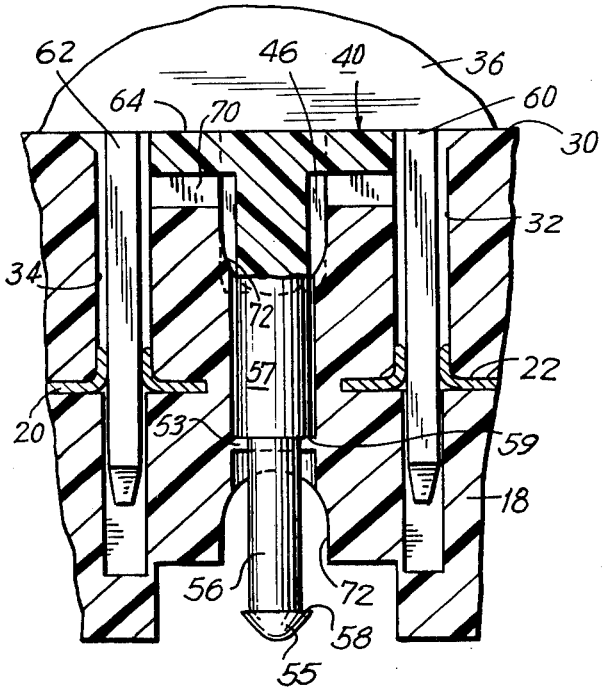
FIG. 5 is an enlarged partial sectional view taken substantially along the line 5—5 of FIG. 4.

As can be seen in the drawings, the face 30 on the female terminal 18 has a pair of spaced terminal openings 32, 34, which are adapted to receive the prongs of a plug 36 as shown in FIG. 5. The terminal openings are represented as being flat longitudinal slots, however, the scope of the present invention is not to be limited thereto or thereby. The safety closure to be described can be used in conjunction with terminal openings of any desired shape. When the prongs of the plug 36 are fully positioned in the terminal openings 32, 34, they bear against the female contacts 20, 22 to complete a portion of an electrical circuit. Similarly, pairs of terminal openings may be placed on the face 38 which is opposite face 30.

While the following description will concern itself with a female terminal having pairs of terminal openings on opposite faces, it is to be understood that the safety closure which will hereinafter be described may be used in conjunction with a female terminal having pairs of terminal openings on adjoining faces as well. As is conventional, pairs of terminal openings on one face are displaced from terminal openings in an opposite face. Where the pairs of openings are on opposite faces it is usual to employ the same contacts 20, 22 for all pairs of openings as is seen for the contact 22 in FIG. 1.

Each pair of terminal openings has associated therewith a safety closure which is permanently fixed thereto for movement between a first and a second position. In its first position the safety closure is recessed in the face of the female terminal between the terminal openings to thereby expose the terminal openings to permit the prongs of a plug to be inserted therein. In its second position, the safety closure dielectrically seals the terminal openings to prevent unwanted deliberate or accidental insertion of an electricity conducting object therein. The first position is, therefore a plug-passing position and the second position is a plug-blocking position.

More specifically, with reference to FIGS. 2, 3, 4, and 5 the pair of terminal openings 32, 34 have associated therewith a safety closure 40 which is molded from a synthetic thermoplastic dielectric material. The safety closure 40 includes an elongated strip 42 with two spaced integral tabs 44, 46 extending at right angles from the same side thereof. The configuration of each tab conforms to the shape of the terminal opening in the face. For a reason which will become apparent, the width of the strip 42 is less than the distance between the associated spaced terminal openings 32, 34 and the length of the strip 42 is greater than said distance.

As mentioned hereinabove, means is included to permanently secure the safety closure 40 on the female terminal for movement between plug-passing and plug-blocking positions. More particularly, said means pivotally secures the safety closure to the female terminal and also permits limited movement thereof toward and away from the face 30 of the female terminal. Said means comprises a pivot pin 50 extending from the strip 42 in the same direction as the tabs 44, 46 and is one-piece therewith. The pin is slidably received in a bore 52 in the terminal. The bore 52 is situated midway between the terminal openings 32 and 34 and has an annular restriction 53 therein. When the pivot pin 50 is inserted in the bore 52, the camming surface 54 on the conical head 55 of the pivot pin enlarges the annular restriction to allow the head 55 to pass therethrough. Once the head has passed through the annular restriction the annular restriction returns to its normal condition. The lower portion 56 of the pivot pin has a diameter slightly less than the upper portion 57 thereof which is of a diameter slightly less than the bore 52. The lower portion 56 is smaller in diameter than the annular restriction so that the pivot pin may slide therethrough.

To prevent dislodgement of the pivot pin from the bore the head 55 and the lower portion 56 of the pivot pin form a shoulder 58 which will strike the annular restriction 53 when the first strip 42 is pulled more than the required distance away from the face 30. It can thus be seen that the safety closure 40, while being locked on the female terminal 18, can be raised, i.e. moved outwardly away from the face 30 as shown in the phantom lines in FIG. 2, can be rotated in relation to the terminal openings, and can be lowered or moved toward the face 30.

Figure 4:
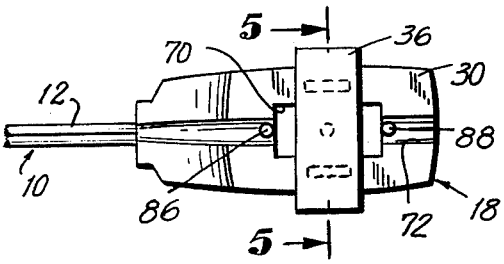
FIG. 4 is a top view of the electrical terminal in accordance with the present invention having a plug positioned thereon and the safety closure in plug-passing position.

The first plug-passing position of the safety closure is illustrated in FIGS. 4 and 5 wherein the plug 36 has prongs 60, 62 extending therefrom which are positioned within the terminal openings 32, 34 respectively. When so positioned the prongs 60, 62 slidably engage the female contacts 20, 22 to complete an electrical circuit. In this first position, the safety closure 40 is fully in the face 30 between the terminal openings so that the top surface 64 of the strip is flush with the face 30. In order to permit such positioning, the face 30 is provided with a longitudinally extending depression or hollow 70 which is slightly greater in its overall dimensions than the overall dimensions of the strip 42. The depression 70 is midway between the openings 32, 34 with its length perpendicular to the span between said openings.

Figure 2:
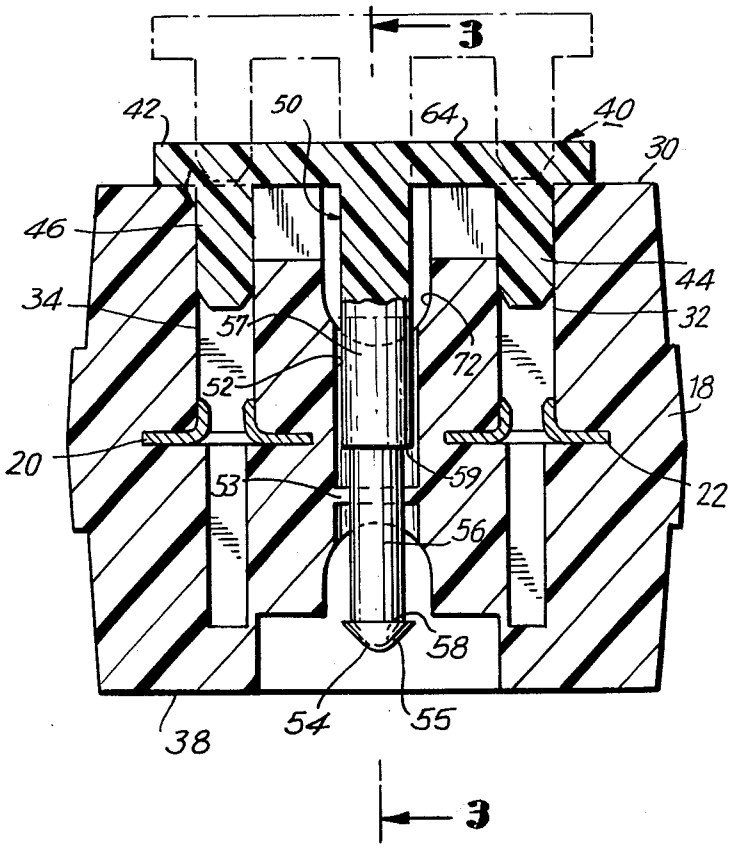
FIG. 2 is an enlarged sectional view taken substantially along the line 2—2 of FIG. 1 with the safety closure in plug-blocking position.
Figure 3:
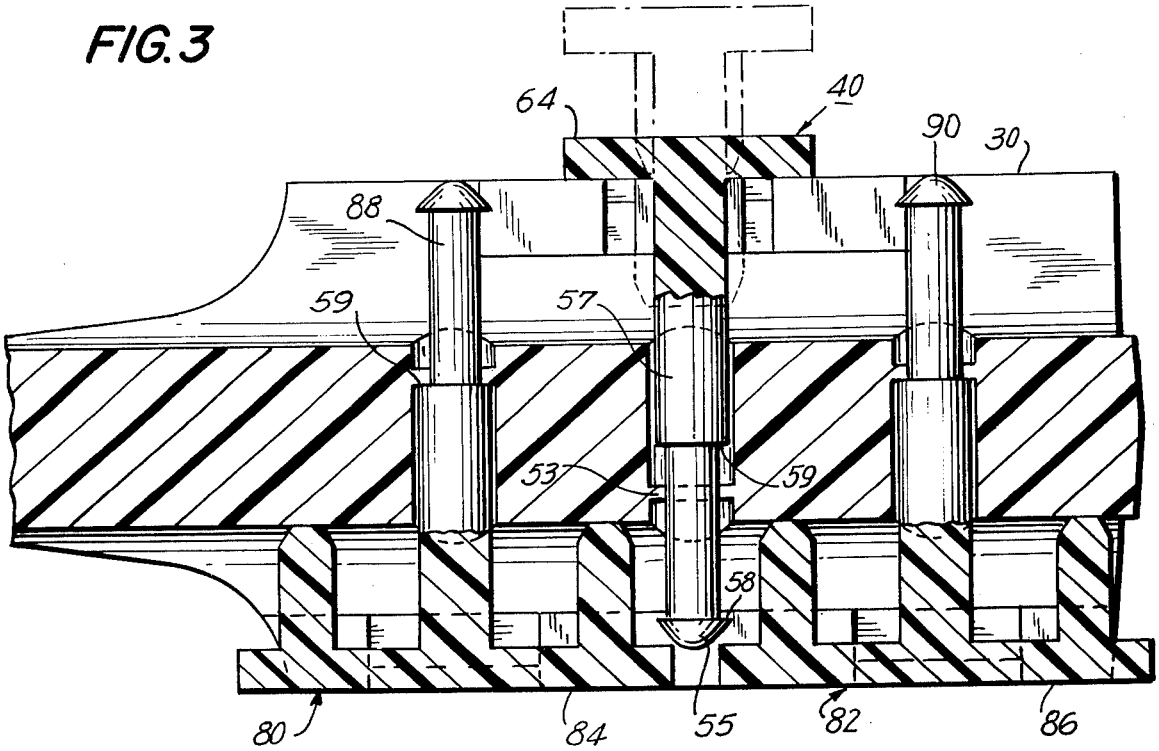
FIG. 3 is a sectional view taken substantially along the line 3—3 of FIG. 2.

Further, the face 30 is provided with a longitudinally extending groove 72 which is parallel to the longitudinal axis of terminal openings and which is adapted to frictionally receive the tabs 44, 46 when the strip 42 is positioned in the depression 70 to secure it in position. The pivot pin 50 may be provided with a second shoulder 59 separating the upper and lower portions 57, 56 which will abut the annular restriction 53 when the strip 42 is urged into the depression or hollow 70 to prevent the strip from moving too far into the depression or hollow so that its removal therefrom is hampered. When the strip is placed in the depression 70, the head 55 of the pivot pin 50 extends from the bore 52 a sufficient distance into the groove 72 in the opposite face of the female terminal so that when the plug is pulled from the female terminal the safety closure may be easily shifted to its second position. If the female terminal has pairs of terminal openings on the opposite face with safety closures associated therewith as shown in FIG. 3, the presence of a longitudinal groove is necessary to permit those safety closures to be placed in their first plug-passing positions. Since by the design of the female terminal the pairs of terminal openings on the two faces are identically disposed with respect to the longitudinal edges of the terminal, when a safety closure on either side is in its first position, its pivot pin will project into the longitudinal groove on the opposite face. To shift a safety closure in its second position, the head 55 is pushed. This will force the strip 42 out of the depression 70 on the opposite face. The strip 42 can then be grasped between the thumb and forefinger and rotated 90° so that the tabs 44, 46 will be positioned directly over the terminal openings 32, 34. The length of the pivot pin and the positioning of the shoulder 58 thereon are such that when the shoulder strikes the annular restriction, a slight clearance is established between the end of the tabs 44, 46 and the face 30 to permit such rotation. The strip 42 then is pressed downwardly toward the face 30 resulting in the tabs frictionally entering the terminal openings and plugging them. A safety closure in its second position is illustrated in FIG. 2 wherein the tabs 44, 46 are shown frictionally received in the terminal openings 32, 34. As mentioned hereinabove, the overall length of the strip 42 is slightly greater than the distance between the spaced terminal openings so that the strip 42 will bear against the face 30 of the female terminal. Since there is friction between the tabs and the terminal openings, some pressure is necessary to dislodge the tabs from the terminal openings. Thus the parts will resist separation so that a small child or infant will not be able to remove the safety closure to gain access to the terminal openings. To unseal the terminal openings the sides of the strip 42 are grasped between the thumb and forefinger and the strip 42 pulled away from the face 30 until the shoulder 58 strikes the annular restriction 53. The strip is rotated 90° so that it is in alignment with and over the hollow 70. The strip can then be urged into the hollow 70 to expose the associated pair of terminal openings.

While the above discussion concerned itself with a female terminal having only one pair of terminal openings in one face, the female terminal may be provided with a plurality of pairs of terminal openings in one face. This configuration can best be seen with reference to FIG. 3 wherein there is illustrated a female terminal having a face 38 being provided with two pairs of terminal openings each having their associated safety closure 80 and 82 which are identical to the safety closure hereinafter described. The safety closures 80 and 82 have strips 84 and 86 which are sized so that both safety closures may be placed in their first position and independently moved to their second position without conflict. The strips 84 and 86 are mounted by pivot pins 88, 90 respectively to the female terminal in a manner identical to strip 42. As mentioned hereinabove, the pivot pins extend into the groove on the opposite face to permit the displacement of the strips from their respective depressions. In this configuration, the face 38 may be provided with one elongated depression extending the length of the face which is adapted to receive both strips.

It can be seen from the foregoing detailed description that the object of the present invention, namely, to create an extension cord terminal having safety closures for the terminal openings has been achieved by providing a cord conductor having two insulated conductor strands with a female terminal included on its end. The female terminal has a pair of female contacts positioned therein which are in permanent electrical connection with their associated conductor strands. The female terminal is provided with a pair of spaced terminal openings therein adapted to frictionally receive the prong of a duplex plug. The pair of terminal openings has a safety closure associated therewith. The safety closure is mounted between the terminal openings and is movable between a first and second position. In its first position, the safety closure is recessed in the female terminal to expose the terminal openings. In its second position, tabs on the safety closure frictionally enter the terminal openings to dielectrically seal the openings.

I claim:

1. In combination:

a. a cord conductor having at least two insulated conductor strands; and b. an electrical terminal comprising:

i. a body of dielectric material having at least one face with at least one pair of spaced terminal openings therein adapted to receive the prongs of a plug;

ii. a pair of female electrical contacts in said body slideably engageable with said prongs, each of said pair of female electrical contacts being in permanent electrical connection with an associated conductor strand in said cord conductor;

iii. a strip of dielectric material associated with said pair of terminal openings:

iv. means for mounting said strip on said body between said pair of terminal openings said mounting means permitting rotational movement of said strip relative to said body between a first position wherein it exposes said pair of terminal openings for reception of said prongs and a second position wherein it blocks said openings, said mounting means permitting limited movement of said strip toward and away from said face, said rotational movement being independent of said limited movement toward and away from said face; and v. a pair of spaced tabs extending at right angles from said strip, said spaced tabs adapted to frictionally enter said pair of terminal openings and seal the same when said strip is in its second position and said strip is moved toward said face.

2. The combination in accordance with claim 1 further including means to secure said strip from movement whtn it is in said first position.

3. The combination in accordance with claim 2 wherein said face is provided with a depression and a longitudinal groove therein, midway between said pair of terminal openings, said depression adapted to receive said strip and said groove adapted to frictionally receive said tabs when said strip is in said first position, so that said strip occupies a recessed position in said face between said pair of terminal openings.

4. The combination in accordance with claim 1 wherein said mounting means comprises:

a. a pivot pin extending from said strip;

b. said face having a bore adapted to receive said pivot pin;

c. an annular restriction in said bore;

d. a head at the end of said pivot pin adapted to pass through said annular restriction when said pivot pin is first inserted in said bore;

e. a first shoulder on said pivot pin adjacent said head to prevent said pivot pin from being pulled from said bore after said head has passed through said annular restriction, said shoulder and annular restriction being positioned so that said strip is allowed rotational movement and limited movement toward and away from said face independent of said rotational movement.

5. The combination in accordance with claim 1 wherein said body is a parallelepiped with at least one face having two pair of spaced terminal openings and the diametrically opposite face having at least one pair of spaced terminal openings.

* * * * *